US005226654A

United States Patent [19]

Solheim

[11] Patent Number: 5,226,654

[45] Date of Patent: Jul. 13, 1993

[54] PUTTER

[75] Inventor: Karsten Solheim, Phoenix, Ariz.

[73] Assignee: Karsten Manufacturing Corp., Phoenix, Ariz.

[21] Appl. No.: 959,494

[22] Filed: Oct. 9, 1992

Related U.S. Application Data

[63] Continuation of Ser. No. 892,618, Jun. 1, 1992, abandoned, which is a continuation of Ser. No. 590,919, Oct. 1, 1990, abandoned.

[51] Int. Cl.[5] ..... A63B 53/02; A63B 53/04

[52] U.S. Cl. ..... 273/164.1; 273/80 A; 273/80 C; 273/167 G; 273/167 F; 273/169

[58] Field of Search ..... 273/167-175, 273/164.1, 77 R, 80.2, 80 C, 80 A, 81.3; D21/217-219

[56] References Cited

U.S. PATENT DOCUMENTS

| | | | |
|---|---|---|---|
| D. 208,414 | 8/1967 | Reuter | 273/80 C X |
| D. 221,446 | 8/1971 | Cook | 273/167 G X |
| D. 228,930 | 10/1973 | Leigh | 273/167 G X |
| D. 230,292 | 2/1974 | Gall | 273/167 G X |
| D. 230,750 | 3/1974 | Ehrich | 273/167 G X |
| D. 240,445 | 7/1976 | Becker | 273/167 G X |
| D. 246,329 | 11/1977 | Little | 273/164 X |
| D. 258,377 | 2/1981 | Nordess et al. | 273/167 G X |
| 2,820,638 | 1/1958 | Morrison | 273/80 C X |
| 2,926,913 | 3/1960 | Stecher | 273/80 C |
| 3,037,770 | 6/1962 | Palmer | 273/80 C |
| 3,042,405 | 7/1962 | Solheim | 273/80 |
| 3,077,350 | 2/1963 | Koorland | 273/80 C |
| 3,194,564 | 7/1965 | Swan | 273/164 X |
| 3,448,981 | 6/1969 | Anweiler | 273/80 C |
| 3,954,265 | 5/1976 | Taylor | 273/80 C |
| 3,966,210 | 6/1976 | Rozmus | 273/169 |
| 3,967,826 | 7/1976 | Judice | 273/167 F |
| 4,265,452 | 5/1981 | Vella | 273/167 G |
| 4,693,478 | 9/1987 | Long | 273/164 |
| 4,754,976 | 7/1988 | Pelz | 273/169 |
| 4,832,340 | 5/1989 | Pickering | 273/80 C X |
| 4,852,879 | 8/1989 | Collins | 273/164 |
| 4,871,174 | 10/1989 | Kobayashi | 273/164 |
| 4,966,369 | 10/1990 | Griffin | 273/80 A |
| 5,004,237 | 4/1991 | Antonious | 273/80.2 |

OTHER PUBLICATIONS

"Golf Digest" Magazine, Apr. 1972 issue, p. 107.

Brochure of Karsten Manufacturing Corporation Copyright 1971—Putters with SZ and Z Shafts.

Advertisement—Tommy Armour Golf, ZAAP Putter Golf Magazine, Jun. 1990 Issue.

*Primary Examiner*—V. Millin

*Assistant Examiner*—Sebastiano Passaniti

*Attorney, Agent, or Firm*—Herbert E. Haynes, Jr.; Darrell Marquette

[57] ABSTRACT

A putter is provided with concentrations of mass in the toe and heel portions, and the putter head is otherwise configured so that its center of gravity is approximately midway between the toe and heel of the putter head. Maximum stability within practical constraints is achieved by an especially configured hosel which extends vertically from proximate the heel of the putter head and positions the putter shaft so that its longitudinal axis intersects an imaginary line at a point forward of the face of the putter with the imaginary line being normal to the face of the putter and passing through the center of gravity thereof.

4 Claims, 1 Drawing Sheet

PUTTER

This is a continuation of copending application Ser. No. 07/892,618 filed on Jun. 1, 1992, abandoned, which is a continuation of Ser. No. 07/590,919 filed Oct. 1, 1990, abandoned.

BACKGROUND OF THE INVENTION

1. Field of the Invention

This invention relates in general to golf clubs and more particularly to a putter structure having an improved balanced design.

2. Description of the Prior Art

As is well known by everyone who plays golf, putting has plagued all types of players, and the quest for improved putters and putting techniques never ends. As recently as about 30 years ago, engineering principles were applied to the design of putters for the first time, and a design which became known as "heel-toe balanced" was devised. Prior to this innovation, putters where for the most part essentially flat, platelike structures commonly referred to as "blade" putters.

Briefly, a putter designed in accordance with the "heel-toe balance" principle has its mass concentrated in the heel and toe of the putter head. This provides an increased moment of inertia that causes the putter head to resist twisting whenever the golf ball is struck at a point on the putter face which is away from the "sweet spot" of the putter. Such a putter is disclosed in my U.S. Pat. No. 3,042,405 which issued on Jul. 3, 1962.

In addition to having the heel-toe balance, my putter design disclosed in U.S. Pat. No. 3,042,405 has another design feature which is commonly referred to as "face balance". A face balanced putter is one having equal moment arms, i.e. the concentrated masses at the heel and toe are equally distant from the axis of rotation. This is accomplished by connecting the shaft of the putter centrally between the toe and the heel of the putter so that it is located proximate the center of gravity.

The face balancing design concept has been accomplished in another manner such as that fully disclosed in U.S. Pat. No. 3,954,265 issued on May 4, 1976 to David L. Taylor. In this case, the shaft is attached to the putter head proximate the heel, and the shaft is bent into a special configuration. The special bends in the shaft are located at its lower end, to conform to the Rules of Golf as defined by the United States Golf Association and the Royal and Ancient regulating body of Scotland. The shaft bends locate the longitudinal axis of the shaft, as defined by the straight portion of the shaft, so that the axis will pass through the center of gravity of the putter head.

I have been marketing another unpatented variation of a putter incorporating the face balanced design concept which I have identified as the "Z" putter. In this particular putter the shaft is bent so that the longitudinal axis of the straight portion of the shaft will intersect a line which extends normally from the face of the putter head with that line also containing the center of gravity of the putter head. This particular version of the face balanced design concept adds a still further putter head stabilization feature to the art of putter head design. By off-setting the shaft axis forwardly of the center of gravity of the putter head, a lever arm is added to the moment of inertia of the putter head about the rotational axis of the shaft. This, of course, further increases the moment of inertia in comparison to a face balanced putter which has its axis of rotation passing through the center of gravity.

Even though the fully balanced prior art putters described above are theoretically ideal, many golfers shy away from center shafted putters, putters with bent shafts, and putters without a hosel. The reasons for this vary considerably, but it all reduces down to personal preferences and what a golfer feels comfortable using.

The most popular putters used today have a hosel extending upwardly from proximate the heel of the putter head a distance of from about two to three inches relative to the sole of the head. The lower end of the shaft is usually secured in a socket-like boss formed on the upper end of the hosel. Such putters are typically heel-toe balanced but are not face balanced due to the rearward disposition of their upwardly extending hosel.

A particular prior art putter marketed under the tradename ZAAP by the Tommy Armour Golf Company, has a hosel and is both heel-toe balanced and face balanced. To accomplish such balancing, the ZAAP putter has its hosel extending upwardly and forwardly from proximate the heel of the head at about a 45° angle and the socket-like boss is disposed at an angle of about 125° relative to the hosel.

The angular orientation of the hosel of the ZAAP putter may disturb some golfers by distracting or otherwise interfering with the high degree of precision visual alignment required for good putting. In addition to such possible optical distraction, the ZAAP putter is configured so that the rotational axis defined by the putter's shaft passes through the center of gravity of the putter and thus lacks the additional stabilizing influence provided by off-setting the shaft axis forwardly of the putter's face so that the shaft axis intersects with the imaginary line which extends formally from the face of the putter head and contains the center of gravity of the putter.

Therefore, a need exists for a new and useful putter which overcomes some of the shortcomings and disadvantages of the prior art.

SUMMARY OF THE INVENTION

In accordance with the present invention, a new and improved putter is disclosed which is configured to provide a high moment of inertia to resist twisting upon the occurrence of off-center hits. Additionally, the putter of the present invention is provided with a hosel to satisfy the desires of many golfers, and the hosel is of optically pleasing design so as to not disturb or otherwise interfere with the high degree of visual alignment required in the art of successful putting.

The putter of present invention has relatively large concentrations of mass at the toe and heel of the putter head to accomplish the well known design objective commonly referred to as heel-toe balancing. Briefly, by concentrating the masses at some distances from the rotational axis of the putter as defined by the longitudinal shaft of the putter, the moment of inertia of the putter is increased in comparison to a flat plate, or blade putter for example, and this stabilizes the putter against twisting in response to off-center hits.

The disclosed putter has a hosel which extends vertically from a point proximate the heel of the putter head and is bent over at a right angle so that the socket-like boss for receiving the putter's shaft which is provided at the upper end of the hosel is off-set forwardly relative to the face of the putter head. The hosel is further configured so that the longitudinal axis of the putter's shaft will intersect a line which extends normally from the face of the putter head with that same line containing the center of gravity of the putter. In this way, two additional stabilizing influences are designed into the putter head.

The first additional stabilizing influence is referred to as face balancing and is accomplished by having the mass concentrations provided at the heel and toe of the putter head at equal distances from the axis of rotation; i.e. the intersection of the shaft axis and the normally extending imaginary line which contains the putter's center of gravity.

The second additional putter head stabilizing influence provided by the special hosel configuration of the present invention, is a direct result of the socket-like boss being located in a forwardly off-set location relative to the putter's center of gravity. Since the center of gravity of a body is a point at which all the weight of the body can be considered as being concentrated, the center of gravity acts in the same manner as the mass concentrations provided at the heel and toe of the putter head. Therefore, the distance between the center of gravity and the intersection point of the shaft axis and the imaginary line described above, provides a lever arm and this further increases the moment in inertia of the putter of the present invention.

Accordingly, it is an object of the present invention to provide a new and improved putter for use in playing the game of golf.

Another object of the present invention is to provide a new and improved putter which has a relatively high moment of inertia to provide a resistance to twisting upon the occurrence of an off-center hit.

Another object of the present invention is to provide a new and improved putter of the above described character which is provided with mass concentrations at the heel and toe of the putter head to increase the moment of inertia of the putter head by providing a stabilizing influence known in the art as heel-toe balancing.

Another object of the present invention is to provide a new and improved putter of the above described type wherein the mass concentrations provided at the heel and toe of the putter head are at equal distances from the axis of rotation of the putter defined by the longitudinal axis of the putter's shaft to provide a stabilizing influence known in the art as face balancing.

Still another object of the present invention is to provide a new and improved putter of the above described character wherein the moment of inertia is further increased by incorporation of a hosel which locates the axis of rotation of the putter at a forwardly off-set location relative to the center of gravity of the putter.

Yet another object of the present invention is to provide a new and improved putter of the above described type wherein maximized stabilization of the putter is provided by a hosel which extends vertically from a point proximate the heel of the putter head and is bent at approximately a right angle at its top so that the socket-like boss provided at the upper end of the hosel for receiving the putter's shaft is located in a forwardly off-set position relative to the face of the putter and will position the shaft so that the shaft's axis will intersect an imaginary line that extends normally from the face of the putter head and contains the center of gravity thereof.

The foregoing and other objects of the present invention as well as the invention itself will be more fully understood from the following description when read in conjunction with the accompanying drawings.

DESCRIPTION OF THE PREFERRED EMBODIMENTS

Figure 1:
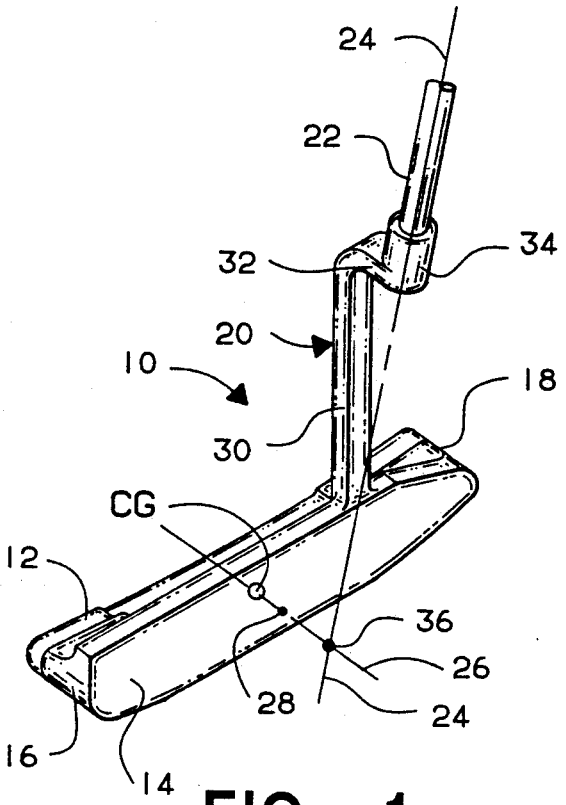
FIG. 1 is a perspective view of a first embodiment of the putter of the present invention.
Figure 2:
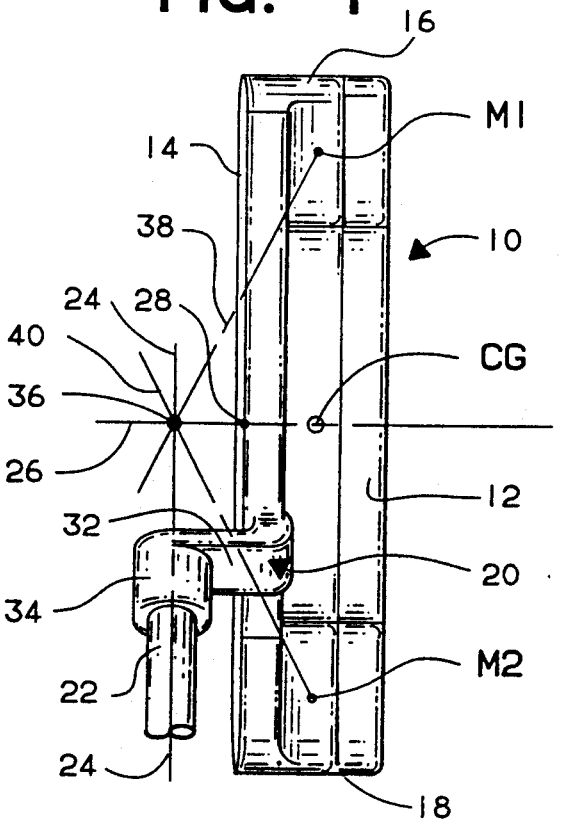
FIG. 2 is an enlarged plan view of the putter shown in FIG. 1.

Referring more particularly to the drawings, FIGS. 1 and 2 show the first embodiment of the putter of the present invention which is indicated generally by the reference numeral 10. The putter 10 includes a putter head 12 having the usual face 14 for impacting a golf ball (not shown), a toe 16 and a heel 18.

In accordance with the present invention, the putter 10 further includes a hosel 20 of special configuration which will hereinafter be described in detail. Although not fully illustrated, it will be understood that as is customary in the art, an elongated shaft 22 has its lower end fixedly attached to the upper end of the hosel 20, and the shaft defines a longitudinal axis 24 and will have the usual grip (not shown) mounted on its upper end.

As is well known, every body has a center of gravity which by definition is a point at which all the weight of the body can be considered as being concentrated. In the putter head 12, the center of gravity is indicated at the point CG. An imaginary line 26 which is normal to the face 14 of the putter head 12 and passes through the CG will also contain a point 28 on the face 14 of the putter head. That point 28 is known in the art as the "sweet spot" of the golf club. When a golf club, the putter 10 in this case, is swung so that its swing path is coincident with the imaginary line 26 and the golf ball is impacted at the sweet spot 28, a maximum energy transfer will occur, and no twisting forces will be exerted on the putter head. However, if the ball is hit in an off-center location relative to the sweet spot 28, a force will be exerted on the putter head 12 which will tend to cause the head to rotate about the longitudinal axis 24 of the shaft 22. More specifically, if the impact point is off-set toward the toe 16 of the putter head 12, the club will tend to rotate in a clockwise direction. Similarly, if the impact occurs at a location which is off-set toward the heel 18 of the putter head 12, the putter 10 will tend to rotate in a counterclockwise direction.

Such undesirable rotation of the putter head 12 will, of course, be resisted by inertia, and the putter 10 of the present invention is configured to maximize the moment of inertia. To achieve this objective, the putter head 12 as seen best in FIG. 2 is provided with a first concentration of mass M1 at the toe 16 of the putter head 12 and a second concentration of mass M2 at the heel 18 thereof. By definition, the moment of inertia of any body with respect to any axis is the sum of the products obtained by multiplying each elementary mass by the square of the distance from the axis. The putter design wherein the mass concentrations are located at the toe and heel, as in the putter 10 of the present invention, is known as heel-toe balance. More specifically, the masses M1 and M2 are located at some distances from the longitudinal axis 24 of the shaft 22, and thus the putter 10 of the present invention is provided with improved stability resulting from heel-toe balancing.

Another design feature which enhances putter stability is known in the art as face balancing, and this occurs when the mass concentrations M1 and M2 are equally distant from the longitudinal axis 24 of the putter shaft 22. And, stability will be further improved if the distances of the masses M1 and M2 are maximized within practical limits. Both of these design objectives are accomplished in the putter 10 of the present invention by the hereinbefore mentioned especially configured hosel 20.

As seen best in FIG. 1, the hosel 20 includes a vertical leg portion 30 which extends from proximate the heel 18 of the putter head 12 and is bent over at its upper end to provide a cantilever arm 32 which extends forwardly of the putter head 12. A socket-like boss 24 is formed on the extending end of the cantilever arm 32, and the lower end of the putter shaft 22 is fixed in the boss 34 as hereinbefore mentioned. The hosel 20 described above is of generally conventional configuration except that the vertical leg portion 30 is longer than usual and the length of that leg is calculated to locate the longitudinal axis 24 of the putter shaft 22 so that it intersects the imaginary line 26 at a point 36.

Therefore, it will be seen that the special hosel configuration described above will locate the longitudinal axis 24 of the shaft 22 so the distances of the masses M1 and M2, as indicated by the imaginary lines 38 and 40 respectively, are equally distant from the axis 24 about which the putter will tend to rotate upon the occurrence of an off-center hit. Further, the distances indicated by the lines 38 and 40 are maximized within practical limits due to the intersection point 36 being off-set forwardly of the putter head 12.

In addition to the above described putter head stabilization design features, another advantage inherently results from the forwardly located intersection point 36. In that the center of gravity CG by definition is the point where all the weight of the club head 12 may be considered as being concentrated, the CG will act as a mass concentration point. Therefore, this mass concentration coupled with the distance between the CG and the axis intersection point 36 produces another moment of inertia which resists twisting of the putter 10 upon the occurrence of an off-center hit.

Figure 3:
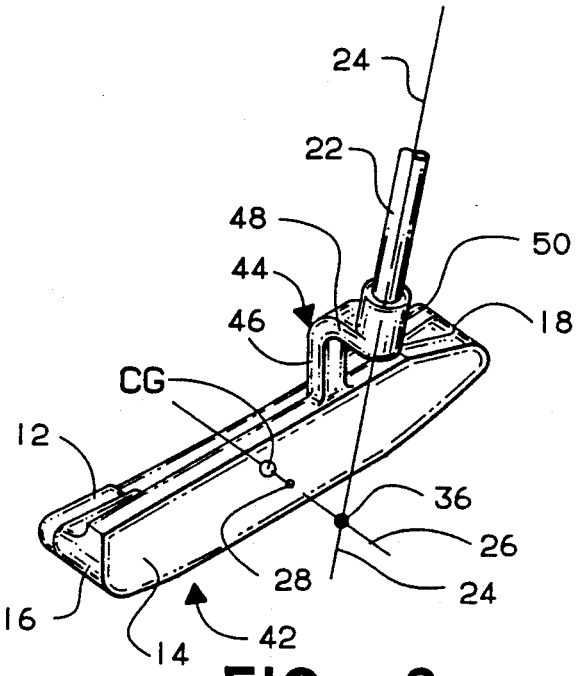
FIG. 3 is a perspective view of a second embodiment of the putter of the present invention.

In accordance with the present invention, the same objectives can be accomplished by the putter shown in FIG. 3 wherein this second embodiment of the present invention is indicated generally by the reference numeral 42.

The putter 42 is provided with the same putter head 12 which, as hereinbefore described, includes the face 14, the toe 16 and the heel 18. The difference between the two putters 10 and 42 is in the hosels, and the hosel of this second embodiment is indicated generally by the reference numeral 44. The hosel 44 has a vertically upstanding leg 46 which is of normal length as compared to the longer than usual length of the leg 30 of the hosel 20 of the putter 10. Similarly however, the hosel 44 has a bent over cantilever arm 48 which extends forwardly with respect to the putter head 12, and a socket-like boss 50 is provided on the extending end of the cantilever arm 48. The longitudinal axis 24 of the putter shaft 22 is brought into the desired intersecting alignment with the imaginary line 26 by selecting the location along the length of the putter head 12 from which the vertical leg 46 extends upwardly.

It will be understood that the design concepts described above as "heel-toe balancing" and "face balancing" are both well known in the art. However, I believe that the hereinbefore described putters 10 and 42 of the present invention are novel in that this is the first time that those design objectives have been accomplished by using a forwardly off-set hosel which adds the further degree of stability resulting from an increase in the lengths of the distances indicated by the imaginary lines 38 and 40, and by providing an elongated moment arm which operates in conjunction with the mass concentration CG. Also, I believe that these objectives are all accomplished by a hosel configuration which is preferred by many and does not distract from the visual alignment task of a golfer.

While the principles of the invention have now been made clear in illustrated embodiments, there will be immediately obvious to those skilled in the art, many modifications of structure, arrangements, proportions, the elements, materials and components used in the practice of the invention and otherwise, which are particularly adapted for specific environments and operation requirements without departing from those principles. The appended claims are therefore intended to cover and embrace any such modifications within the limits only of the true spirit and scope of the invention.

What I claim is:

1. A face-balanced golf club for putting comprising:

a) a putter head having a face, a toe and a heel and having a center of gravity which is located within said putter head and lies on a first imaginary line that extends normally relative to the face of said putter head;

b) an elongated shaft having a longitudinal axis and a lower end;

c) a hosel having a leg portion with a lower end and an upper end, said leg portion extending upwardly and generally vertically from its lower end which is attached to said putter head proximate the heel of said putter head to its upper end which is disposed above said putter head, an arm portion integral with the leg portion and extending at approximately a right angle from the upper end of said leg portion in a direction that is forwardly offset relative to the face of said putter head, and a boss on a forwardly extending end of the arm portion to which the lower end of said shaft is attached, said hosel being configured so that an extension of the longitudinal axis of said shaft intersects said first imaginary line at an intersection point which is forwardly disposed relative to both the center of gravity and the face of said putter head; and d) first and second mass concentrations located adjacent the toe and heel, respectively, of said putter head, each of said first and second mass concentrations being arranged such that the length of a second imaginary line extending from said first mass concentration to said intersection point is equal to the length of a third imaginary line extending from said second mass concentration to said intersection point, said first and second mass concentrations being disposed on opposite sides of the center of gravity of the putter head and being generally aligned with each other in a heel-to-toe direction.

2. A gold club as claimed in claim 1 wherein said first and second mass concentrations and said putter head are configured so that said center of gravity is disposed substantially centrally of said putter head intermediate the toe and heel thereof.

3. A face-balanced golf putter comprising:

a putter head having a face for impacting a golf ball, a toe and a heel, said putter head having a center of gravity which lies on a first imaginary line that extends substantially normally to the face of said putter head, said face having a sweet spot arranged such that when a golf ball is impacted at said sweet spot no twisting forces are exerted on said putter head, said sweet spot also lying on said first imaginary line;

an elongated shaft having a longitudinal axis and a lower end;

a hosel for connecting said putter head to said elongated shaft, said hosel including a leg portion, a cantilever arm and a boss;

said hosel leg portion having a lower end which is attached to said putter head intermediate said first imaginary line and said heel, said hosel leg portion also having an upper end which is disposed above said putter head, said hosel leg portion extending upwardly and generally vertically from said lower end to said upper end;

said cantilever arm of said hosel being integrally connected with said upper end of said hosel leg portion and extending therefrom at approximately a right angle in a forward direction relative to said putter head;

said boss being integrally connected to a forwardly extending end of said cantilever arm for receiving said lower end of said elongated shaft;

said hosel leg portion and said cantilever arm being configured for positioning said boss and said elongated shaft so that an extension of said shaft longitudinal axis intersects said first imaginary line at an intersection point which is located substantially forwardly of both said sweet spot and said center of gravity; and first and second mass concentrations located adjacent the toe and heel, respectively, of said putter head, each of said first and second mass concentrations being arranged such that the length of a second imaginary line extending from said first mass concentration to said intersection point is equal to the length of a third imaginary line extending from said second mass concentration to said intersection point, said first and second mass concentrations being disposed on opposite sides of the center of gravity of the putter head and being generally aligned with each other in a heel-to-toe direction.

4. The face-balanced golf putter of claim 3, wherein:

said center of gravity is located within said putter head substantially equidistant from said first and second mass concentrations.

* * * * *